United States Patent [19]

Ito et al.

[11] Patent Number: 4,938,844

[45] Date of Patent: Jul. 3, 1990

[54] PROCESS FOR PRODUCING FIBER AGGREGATE

[75] Inventors: Tomohito Ito, Ohbu; Hidetoshi Hirai, Ichinomiya; Renichi Isomura, Kariya; Fukuo Gomi, Nagoya; Senichi Masuda, Tokyo, all of Japan

[73] Assignees: Kabushiki Kaisha Toyoda Jidoshokki Seisakusho; Senichi Masuda, both of Kariya, Japan

[21] Appl. No.: 177,467

[22] Filed: Apr. 1, 1988

[30] Foreign Application Priority Data

Apr. 4, 1987 [JP] Japan ..... 62-83567

[51] Int. Cl.[5] ..... D21H 5/00

[52] U.S. Cl. ..... 162/102; 162/145; 162/152; 162/192; 264/108

[58] Field of Search ..... 162/192, 108, 102, 145, 162/152; 264/108

[56] References Cited

U.S. PATENT DOCUMENTS 3,497,419 2/1970 Winer et al. ..... 162/192

4,786,366 11/1988 Ito et al. ..... 162/102

FOREIGN PATENT DOCUMENTS 60-65200 4/1985 Japan .

62-162062 7/1987 Japan .

*Primary Examiner*—Peter Chin

*Assistant Examiner*—Thi Dang

*Attorney, Agent, or Firm*—Berman, Aisenberg & Platt

[57] ABSTRACT

The present invention relates to a process for producing fiber aggregate which includes an orientation step of placing the dielectric fluid containing fibers in the form of short fiber, whisker, or a mixture thereof dispersed therein in a space between a pair of electrodes across which an AC voltage is applied, whereby causing individual fibers in the dielectric fluid to electrostatically orient, with one end pointing to one of electrodes and the other end pointing to the other electrode; and an aggregating step of aggregating the electrostatically oriented fibers while keeping the oriented step, whereby producing fiber aggregate in which the fibers are substantially one-dimensionally oriented.

5 Claims, 3 Drawing Sheets

(PRIOR ART)

PROCESS FOR PRODUCING FIBER AGGREGATE

BACKGROUND OF THE INVENTION

1. Field of the Invention

The present invention relates to a process for producing fiber aggregate, and more particularly, it relates to a process for producing fiber aggregate in which most fibers are about one-dimensionally oriented, by utilizing an AC power source. "One-dimensionally oriented" means that many fibers are oriented in substantially the same direction. This definition is applied not only to the fiber aggregate but also to the orientation step mentioned later.

2. Prior Art

Heretofore, fiber aggregate of short fibers or whiskers has been produced in the following means.

A centrifugal forming method which employs a centrifugal forming apparatus as shown in FIG. 3 (Japanese Unexamined Patent Publication No. 65200/1985). According to this method, an aqueous suspension of silicon carbide whiskers or the like is fed through the supply pipe 24 to the porous long cylindrical vessel 23 which is lined with the filtration film 25 and disposed in the outer cylinder 21. The cylindrical vessel 23 is rotated rapidly. As a result, fibers are attracted toward the inner surface of the cylindrical vessel 23. Then water is discharged from the outlet 22 and cylindrical fiber aggregate 26 is formed on the inner surface of the cylindrical vessel 23.

Another conventional method which employs a suction forming apparatus is as shown in FIG. 4. According to this method, a prescribed amount of fiber-containing fluid 34 is fed to the cylinder 31, and a pressure is applied to the fluid 34 by the plunger 32 arranged above the cylinder 31. At the same time, the filtrate is removed by vacuum suction through the filter 33 disposed at the bottom of the cylinder 31. Thus the fibers in the fluid are oriented and aggregate.

Other conventional methods include the papermaking method and spraying method.

The fiber aggregate formed by the centrifugal method or suction method is not composed of one-dimensionally oriented fibers, but is composed mainly of two dimensionally oriented fibers. The fiber aggregate with such orientation has a disadvantage that it does not provide a sufficient strength in the desired one-dimensional direction when incorporated into fiber-reinforced metal (referred to as FRM hereinafter). Additional disadvantages are the low volume ratio of fiber. If fibers are two- or three-dimensionally oriented, there is apt to be produced some space between fibers. Consequently, a density of fibers in a given space becomes lower accordingly.

SUMMARY OF THE INVENTION

The present invention overcomes the above mentioned disadvantages and is an improvement of Japanese Patent Application No. 299,558/1985, filed by the same Applicant as that of this invention. In Japanese Patent Application No. 299,558/1985, now U.S. Pat. No. 4,786,366 there is shown a method of dispersing the fibers in the dielectric fluid and then subjecting the dispersed fibers to an electric field formed between electrodes upon which a D.C. high voltage is applied. The individual fibers which have been electrostatically oriented as mentioned above are mostly strung to one another in one direction (referred to as electrode direction hereinafter) perpendicular to the direction in which the fibers settle. The stringing fibers settle faster than discrete fibers.

It is an object of the present invention to provide a process for producing a homogeneous fiber aggregate in which most fibers are one-dimensionally oriented, being subjected to the electric field formed in the dielectric fluid between electrodes upon which an AC voltage is applied, instead of a D.C. high voltage. The fiber aggregate produced according to the process of the present invention has a high fiber volume ratio and a low degree of spring back with a uniform fiber orientation. When incorporated into FRM (Fiber Reinforced Metal), it provides FRM having a high strength in the desired one dimension. Further, it makes it possible to use the dielectric fluid repeatedly without causing undesirable convection of the dielectric fluid which disturbs orientation of fibers as well as to get a long stable operation for producing the fiber aggregate.

DETAILED DESCRIPTION OF THE DRAWINGS

These and other objects, as well as features of this invention will become apparent by reading the following description referring to the accompanying drawings, wherein.

DETAILED DESCRIPTION OF THE INVENTION

Figure 1:
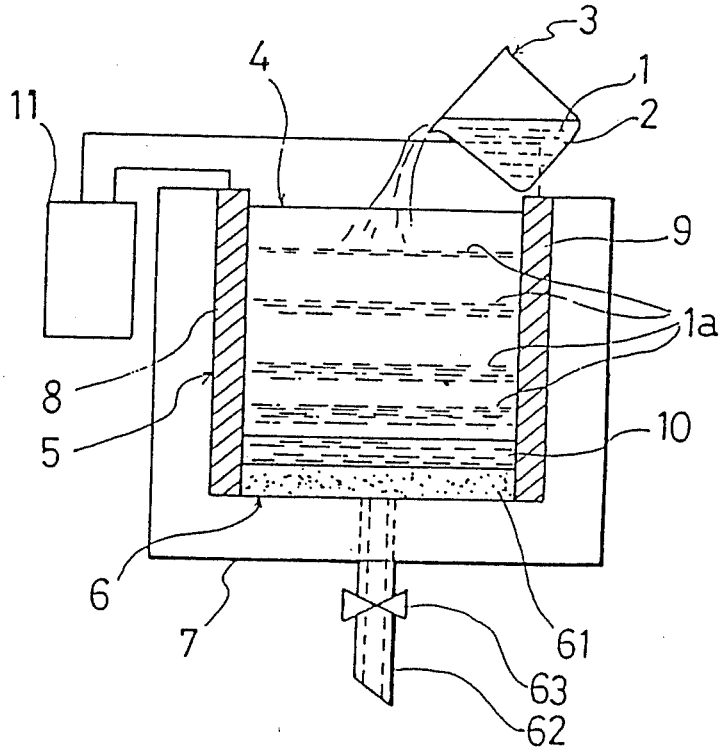
FIG. 1 is a schematic sectional view illustrating the process for producing fiber aggregate, said process including the step of filtering the dielectric fluid through a porous filter.

The first step of the process of the present invention for producing fiber aggregate is the orientation step in which short fibers, whiskers, or a mixture thereof are dispersed into a dielectric fluid.

The fibers used in this orientation step are short fibers, whiskers or a mixture thereof. Short fibers and whiskers of any kind can be used. They are not specifically limited in diameter and length. Also, they are not limited in material so long as they are capable of electrostatic orientation in the dielectric fluid when a AC voltage is applied across the electrodes. The material of the fiber includes, for example, alumina, silica, alumina-silica, beryllia, carbon, silicon carbide, glass, and metals. Either fibers of single material or a mixture of fibers of different materials may be used.

The dielectric fluid means a fluid which has high electrical insulation resistance. For example, the dielectric fluid has electric resistivity of not less than $10^{11}\Omega$cm. Examples of the dielectric fluid include carbon tetrachloride, fluorine- and chlorine-substituted hydrocarbon, n-hexane, and cyclohexane. These are organic solvents and have comparatively low molecular weight and viscosity. Therefore, they do not impede the velocity of the fibers and the velocity of fiber orientation, and sedimentation of the fiber aggregate is increased. Preferable among them is carbon tetrachloride. Fluorine- and chlorine-substituted hydrocarbons are preferable from the standpoint of handling safety.

Fibers of some kind or state may need surface treatment to loosen fibers sticking together. To facilitate the dispersion of fibers, a proper amount of surface active agent, especially a nonionic surface active agent should be added to the dielectric fluid. In particular, the addition of the surface active agent is effective in separating microscopically small fibers. Furthermore, the addition of the surface active agent facilitates electric polarization of the fibers. Consequently, the degree of polarization as well as the speed of polarization increases, and thus orientation of the fibers increases in the presence of the surface active agent. As regards the amount of surface active agent, it is difficult to fix it. Most of surface active agents are adsorbed onto the fibers, and a part of them is dissolved in the dielectric fluid. Therefore, the more the amount of fibers dispersed into the dielectric fluid is, the more the amount of surface active agent required is.

For instance, in the case of alumina fiber or SiC whisker, the amounts (mg) of surface active agent which orient the fibers effectively in the dielectric fluid of one liter can be seen in Table 1 and Table 2.

TABLE 1

| | | | | | | |
|---|---|---|---|---|---|---|
| Alumina fiber (g/l) | 5 | 10 | 20 | 50 | 100 | 200 |
| Active agent (mg/l) | 5–50 | 10–110 | 25–250 | 55–400 | 110–1000 | 220–1500 |

TABLE 2

| | | | | | |
|---|---|---|---|---|---|
| SiC wisker (g/l) | 1 | 5 | 10 | 20 | 50 |
| Active agent (mg/l) | 5–7 | 20–35 | 40–70 | 85–140 | 210–350 |

In this orientation step, the dielectric fluid containing the fibers dispersed therein is placed in a space between a pair of electrodes across which the AC voltage is applied, so that individual fibers in the dielectric fluid are electrostatically oriented, with one end pointing to one of said electrodes and the other end pointing to the other said electrode. The state in which most fibers are oriented in one direction across the electrodes is referred to as "one-dimensional orientation".

In the orientation step, a high AC voltage is applied between the electrodes. Usually an electric field of about 0.1 to 5 kV/cm in terms of peak to peak (between the highest voltage and the lowest voltage) is generated between these electrodes. An electric field weaker than or equal to 0.1 kV/cm is not enough for the electrostatic orientation of fibers; and an electric field stronger than or equal to 5 kV/cm disturbs the dielectric fluid and interferes with the orientation of fibers. Preferred electric field is about 1 to 2 kV/cm. It is suitable for electrostatic orientation of fibers with a minimum disturbance of the dielectric fluid. The intensity of electric field should be properly established according to the dielectric properties of the fibers and dielectric fluid to be used and the thickness of the fiber aggregate to be produced. Preferred AC frequency in the orientation step is 0.5–100 Hz. If the frequency becomes smaller than this preferred range, it is liable to cause convection and fiber sticking phenomena. On the contrary, if the frequency becomes larger than the above specified range, an electrostatic orientation can not be obtained.

The individual fibers which have been electrostatically oriented as mentioned above are mostly strung to one another in one direction (referred to as electrode direction hereinafter) perpendicular to the direction in which the fibers settle. The stringing fibers settle faster than discrete fibers.

As for waveform of the AC voltage, it is desirable to use the AC frequency with rectangular waveform. Such rectangular waveform has an advantage that no delay occurs in the rise time.

The second step of the process of the present invention is the aggregating step in which the electrostatically oriented fibers are aggregated while keeping the oriented state, whereby producing fiber aggregate in which the fibers are mostly one-dimensionally oriented. This step is the same as that of using a DC voltage.

The aggregating step is performed by gravitationally settling the fiber which have been oriented in the orientation step, for example in the state of closing a drain cock 63 on a drain pipe 62, as shown in FIG 1. Further, the aggregating step is performed by filtering the dielectric fluid containing the fibers which have been oriented in the orientation step, in the direction perpendicular to the direction of the orientation of the fibers so that the oriented fibers 1*a* are collected on the filter 61, for example in the state of opening the drain cock 63 on the drain pipe 62, as shown in FIG 1. According to this method of filtering the dielectric fluid, the aggregation of fiber can be carried out in a short time. The filtering can be performed in the state of vacuum suction. The dielectric fluid may be removed through the filter disposed at the whole filtration surface in which the oriented fibers are aggregated. Therefore, convection of the dielectric fluid discharged is prevented and hence the orientation of the fibers is not disturbed and fiber aggregate of good orientation is obtained. The filter can be composed of porous ceramics.

The above-mentioned orientation step and aggregating step can be performed continuously.

According to the process of the present invention, a fiber aggregate with its thickness being relatively thick in the form of mat and a fiber aggregate with its thickness being relatively thin in the form of film can be obtained.

The one-dimensionally oriented fiber removed from the apparatus is cut to desired shape or placed on top of another to form a fiber aggregate for FRM.

The apparatus used for the process of the present invention is schematically shown in FIG. 1. It is made up of the orientation vessel 7, the paired electrode 8 and electrode 9, and the AC source 11. The orientation vessel 7 is made up of a receptacle 4 to receive the dielectric fluid 2 into which short fibers 1 are dispersed; the outlet 6 to discharge the dielectric fluid 2; and the orientation space 5 in which the dielectric fluid moves downward across the receptacle 4 and the outlet 6. The electrode 8 and electrode 9 are vertically disposed a certain distance apart horizontally in the orientation space 5 of the orientation vessel 7. The AC voltage source 11 applies a high voltage across the electrode 8 and electrode 9. The supply unit 3 to feed the fiber-dispersed dielectric fluid may be installed above the receptacle 4.

The process of the present invention uses the AC voltage in the orientation step, whereby it is possible to remove or minimize ions and ionic substances. Thus, a long and stable operation is possible. Also, this makes it possible to use the dielectric fluid repeatedly without causing its undesirable convection.

According to the process of the present invention, it is possible to produce fiber aggregate in which most fibers are one-dimensionally oriented with a minimum of fiber entanglement. Therefore, the thus obtained fiber aggregate has a high fiber volume ratio. Such fiber aggregate provides FRM having a high strength.

According to the process of the present invention, fiber aggregate is produced by the process comprising the orientation step of placing a dielectric fluid containing fibers dispersed therein in a space between a pair of electrodes across which a high AC voltage is applied, whereby causing individual fibers in the dielectric fluid to electrostatically orient, with one end pointing to one of said electrodes and the other end pointing to the other said electrode; and the aggregating step of aggregating the electrostatically oriented fibers while maintaining the direction of orientation of the fibers. Thus, according to the process of this invention, convection of the dielectric fluid and sticking of fibers to electrodes can be prevented. The fiber aggregate produced by this process is one in which said fibers are substantially one-dimensionally oriented. The fiber aggregate provides FRM having an extremely high strength in the direction of one-dimensional orientation.

DETAILED DESCRIPTION OF THE PREFERRED EMBODIMENT

The invention is now described with reference to the following example.

(Example)

This example is designed to investigate the state of the sticking of fibers to the electrodes and of the one-dimensional orientation of fibers.

Figure 2:
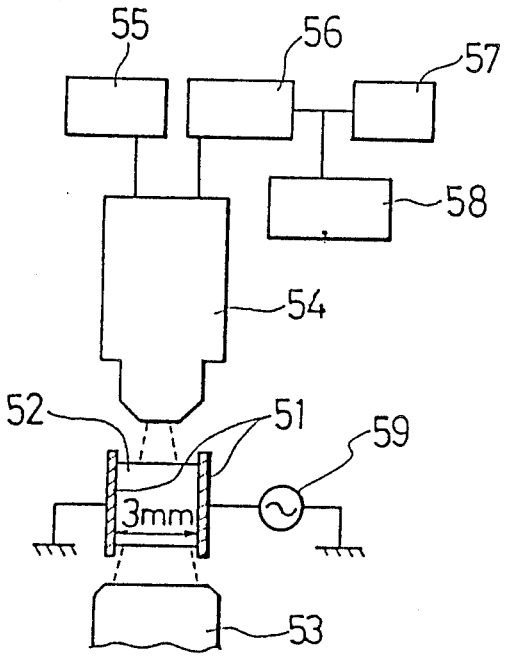
FIG. 2 is a schematic view showing the arrangement of the apparatus used in Example.
Figure 3:
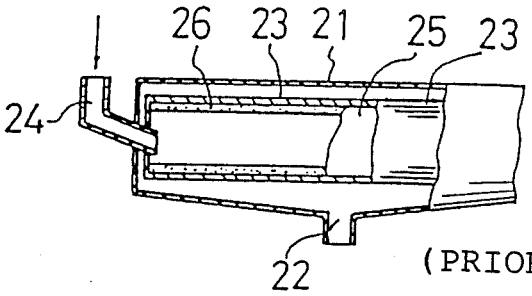
FIG. 3 is a partly cut away sectional view of the conventional centrifugal forming apparatus.
Figure 4:
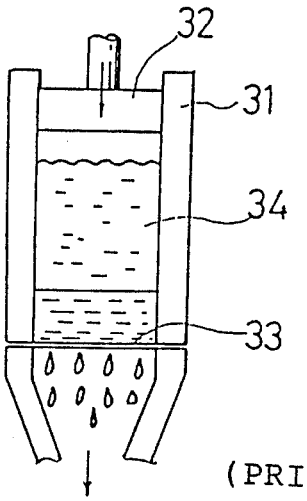
(PRIOR ART) FIG. 4
FIG. 4 is an illustrative sectional view of the conventional suction forming apparatus.

The apparatus used for investigation as shown in FIG. 2 is made up of the glass cell 52 with a pair of electrodes 51, having a distance of 3 mm therebetween, an illuminating instrument 53 disposed on one side of the glass cell 52, a microscope 54 disposed on the other side of the glass cell 52, a photographic camera 55, a video camera 56, a monitor 57 and a video tape recorder 58.

Connected to the electrode 51 is a variable frequency voltage source 59 having 400 V.

The dielectric fluid in the cell 52 is "freon" (R-113) (trademark). The fluid in which alumina whiskers with average diameter of 3 μm and average length of 50 μm and Ply-surf A212C (non-ionic type anionic surface active agent produced by DAIICI KOGYO SEIYAKU Co. LTD.) are dispersed was added into the dielectric fluid. The alumina whisker is 10 gram and the surface active agent is 20 mg, respectively, per liter of "freon".

The following Table 3 shows the test result. It is recognized from this table that satisfying result can be obtained in the AC frequency range form 0.5 Hz to 100 Hz.

TABLE 3

| AC Hz | Sticking of fibers to electrodes | orientation state | convection of fluid |
|---|---|---|---|
| (DC) | X | O | Δ |
| 0.1 | X | O | Δ |
| 0.5 | Δ | O | O |
| 1.0 | O | O | O |
| 5 | O | O | O |
| 10 | O | O | O |
| 50 | O | Δ | O |
| 100 | O | Δ | O |
| 200 | O | X | O |

In the above table, X denotes bad,
O denotes excellent, and
Δ denotes good.

What is claimed is:

1. A process for producing fiber aggregate which comprises:

an orientation step of placing a liquid mixture consisting essentially of a dielectric fluid comprising a low molecular weight, low viscosity, organic solvent having an electric resistivity of not less than 10″Ωcm., a surface active agent, and fibers in the form of short fiber, whisker, or a mixture thereof dispersed therein between a pair of electrodes across which an AC voltage is applied, wherein individual fibers in said liquid mixture are electrostatically oriented, with one end pointing to one of said electrodes and the other end pointing to the other said electrode; and an aggregating step of aggregating the electrostatically oriented fibers by filtering said liquid mixture while maintaining the direction of orientation of the fibers wherein fiber aggregate in which said fibers are substantially one-dimensionally oriented is produced, and wherein said dielectric fluid is selected from the group consisting of carbon tetrachloride, fluorine- and chlorine-substituted hydrocarbons, n-hexane and cyclohexane.

2. A process for producing fiber aggregate as claimed in claim 1, wherein the AC frequency of said AC voltage is between 0.5 Hz and 100 Hz.

3. A process for producing fiber aggregate as claimed in claim 1, wherein the AC frequency of said AC voltage is between 1 Hz and 100 Hz.

4. A process for producing fiber aggregate as claimed in claim 1, wherein said AC voltage has a rectangular waveform.

5. A process for producing fiber aggregate as claimed in claim 1, wherein said fiber is selected from the group consisting of alumina, silica, alumina-silicate, carbon and silicon.

* * * * *

UNITED STATES PATENT AND TRADEMARK OFFICE

CERTIFICATE OF CORRECTION

PATENT NO. : 4,938,844

DATED : JULY 3, 1990

INVENTOR(S) : ITO, ET AL.

It is certified that error appears in the above-identified patent and that said Letters Patent is hereby corrected as shown below:

ON TITLE PAGE:

The identification of Assignees is corrected to:

--Kabushiki Kaisha Toyoda Jidoshokki Seisakusho, Kariya; Senichi Masuda, Tokyo; both of Japan.--;

Claim 3, line 3, change "100 Hz" to --10Hz--;
Claim 5, line 3, before "carbon", insert --beryllia,--.

Signed and Sealed this

Twenty-eighth Day of January, 1992

*Attest:*

HARRY F. MANBECK, JR.

*Attesting Officer*

*Commissioner of Patents and Trademarks*